US009561681B2

(12) United States Patent
Magley

(10) Patent No.: US 9,561,681 B2
(45) Date of Patent: Feb. 7, 2017

(54) FOLDABLE GREETING CARD AND TISSUE BOX COVER

(71) Applicant: DaySpring Cards, Inc., Siloam Springs, AR (US)

(72) Inventor: Rick Magley, Siloam Springs, AR (US)

(73) Assignee: Crayola, LLC, Easton, PA (US)

( * ) Notice: Subject to any disclaimer, the term of this patent is extended or adjusted under 35 U.S.C. 154(b) by 0 days.

(21) Appl. No.: 14/618,737

(22) Filed: Feb. 10, 2015

(65) Prior Publication Data

US 2015/0224807 A1 Aug. 13, 2015

Related U.S. Application Data

(60) Provisional application No. 61/937,776, filed on Feb. 10, 2014.

(51) Int. Cl.

| | |
|---|---|
| ***G09F 1/06*** | (2006.01) |
| ***B42D 15/04*** | (2006.01) |
| *A47K 10/18* | (2006.01) |

(52) U.S. Cl.

CPC ..... *B42D 15/042* (2013.01); *A47K 10/185* (2013.01); *G09F 1/06* (2013.01)

(58) Field of Classification Search

CPC ..... G09F 1/06; G09F 1/08; G09F 1/04; B42D 15/042; B42D 15/045; B65D 5/62; B65D 75/08; B65D 65/22; B65B 11/42; B65B 11/46

See application file for complete search history.

(56) References Cited

U.S. PATENT DOCUMENTS

| | | | | |
|---|---|---|---|---|
| 1,861,206 | A * | 5/1932 | Burgess | 229/103 |
| 2,797,041 | A * | 6/1957 | Rondone | 47/84 |
| 3,979,019 | A * | 9/1976 | Bliss | 221/48 |
| 4,084,015 | A * | 4/1978 | Patterson | 428/9 |
| 6,591,989 | B2 | 7/2003 | McNeill | |
| 7,377,391 | B2 * | 5/2008 | Long et al. | 206/494 |
| 7,451,874 | B2 * | 11/2008 | Kleinsmith | 206/494 |
| 2001/0052477 | A1 * | 12/2001 | McNeill | 206/494 |
| 2006/0219764 | A1 * | 10/2006 | Copeman | 229/116.1 |
| 2006/0249563 | A1 | 11/2006 | Van Vugt | |
| 2006/0283924 | A1 * | 12/2006 | McDaniel et al. | 229/117.01 |
| 2014/0021215 | A1 * | 1/2014 | Tran | 221/45 |

FOREIGN PATENT DOCUMENTS

| | | | |
|---|---|---|---|
| JP | 3161284 U | * | 7/2010 |
| JP | 2013151318 A | * | 8/2013 |

* cited by examiner

*Primary Examiner* — Cassandra Davis

(57) ABSTRACT

A greeting card tissue box cover is provided. In one embodiment, the greeting card body is arranged in a single plane, having first, second, third, and fourth panels that are foldable along multiple fold lines to arrange the greeting card body into a plurality of folded positions. In a first, collapsed position, the greeting card is folded such that each of the multiple panels is parallel to a single plane, thereby enabling mailing of the folded greeting card. In a second, expanded position, the once-collapsed greeting card is configured such that the first, second, third, and fourth panels contour to the exterior of a tissue box, providing a cover thereto. At least two flaps of the greeting card body adjoin a top surface of the tissue box while permitting access to the contents of the tissue box.

19 Claims, 5 Drawing Sheets

FOLDABLE GREETING CARD AND TISSUE BOX COVER

CROSS-REFERENCE TO RELATED APPLICATIONS

This application claims priority to U.S. Provisional Patent Application No. 61/937,776, filed Feb. 10, 2014, entitled "Foldable Greeting Card And Tissue Box Cover," the entire content of which is hereby incorporated by reference.

SUMMARY

Embodiments of the invention are defined by the claims below, not this summary. A high-level overview of various aspects of the invention are provided here for that reason, to provide an overview of the disclosure, and to introduce a selection of concepts that are further described in the detailed description section below. This summary is not intended to identify key features or essential features of the claimed subject matter, nor is it intended to be used as an aid in isolation to determine the scope of the claimed subject matter.

In brief and at a high level, this disclosure describes, among other things, a foldable greeting card and tissue box cover. In particular, embodiments of the invention are directed to a printed greeting card body that is configured to fold into a flat greeting card for mailing in a collapsed position, and later fold into a tissue box cover in an expanded position. In embodiments, an outside message and an inside message are printed on the greeting card body on corresponding panels such that, upon folding of the greeting card body, the messages appear on the front and inside of the greeting card, respectively. Accordingly, once expanded to the tissue box cover configuration, both the inside and outside messages may be viewed.

DESCRIPTION OF THE DRAWINGS

Illustrative embodiments of the invention are described in detail below with reference to the attached drawing figures, and wherein.

DETAILED DESCRIPTION

Figure 1:
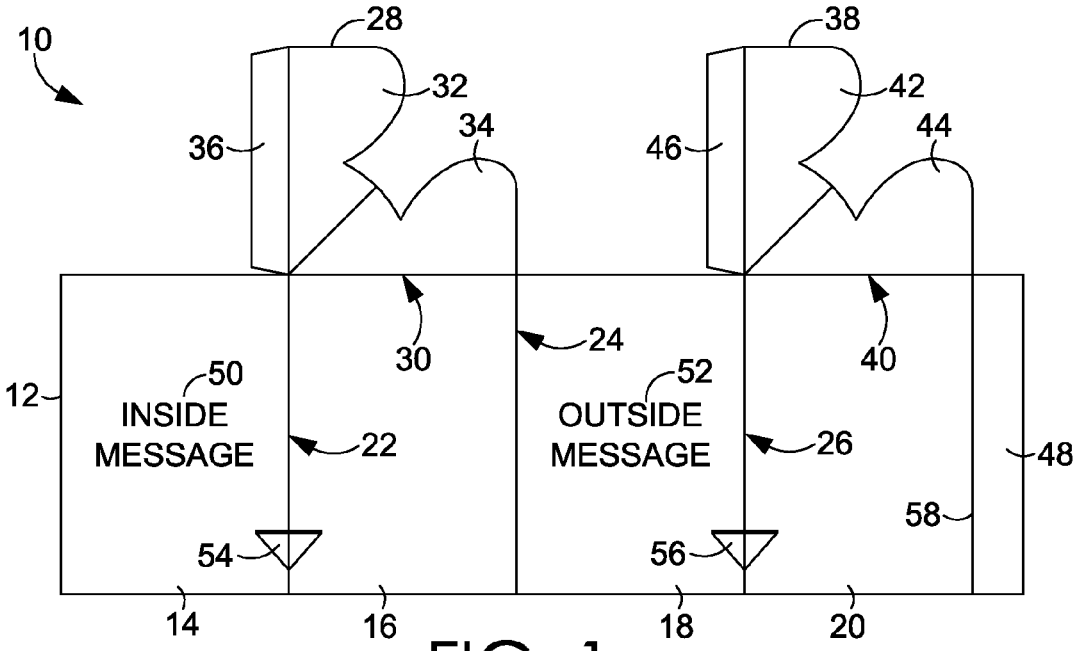
FIG. 1 is a plan view of a greeting card body, in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

A foldable greeting card and tissue box cover is described herein. Embodiments of the invention are directed to a greeting card body that is configured to fold into a flat greeting card for mailing in a collapsed position, and later fold into a tissue box cover in an expanded position. In some aspects of the invention, the greeting card body may be configured to fold from a flat greeting card in a collapsed configuration, into an expanded configuration with an internal cavity for enclosing an object, such as a tissue box. The tissue box enclosed and/or covered by the expanded greeting card body may be any configuration of tissue box corresponding to the expanded greeting card body. As such, one or more portions of the tissue box may be square, rectangular, cubed, or otherwise configured to have a shape for covering by the greeting card body. In one aspect, the panels of the greeting card body are configured to cover a cube-shaped tissue box having square sides, while in another embodiment, the panels of the greeting card body correspond to rectangular sides of an elongated tissue box structure. In further aspects, the various panels of the greeting card body may be planar, curved, or otherwise textured for contouring and/or covering one or more surfaces of the tissue box structure. As such, the greeting card body may be formed of a rigid and/or semi-rigid material that is foldable into a compressed configuration, and expanded into a stand-alone configuration, depending on whether the greeting card body is being delivered to a recipient (compressed) or being displayed in association with a corresponding tissue box structure (expanded).

In one embodiment, the greeting card body is arranged in a single plane, having first, second, third, and fourth panels that are foldable along multiple fold lines to arrange the greeting card body into a plurality of folded positions. In a first, collapsed position, the greeting card is folded such that each of the multiple panels is parallel to a single plane, thereby enabling mailing of the folded greeting card. In a second, expanded position, the once-collapsed greeting card is configured such that the first, second, third, and fourth panels contour to the exterior of a six-sided structure, such as a tissue box, providing a cover thereto. At least two flaps of the greeting card body adjoin a top surface of the tissue box, while permitting access to the contents of the tissue box.

In embodiments, an outside message and an inside message are printed on the printed greeting card body on corresponding panels such that, upon folding of the greeting card body into the collapsed position, the messages appear on the front and inside of the greeting card, respectively.

Accordingly, once expanded into the tissue box cover configuration, both the inside and outside messages may be viewed.

Accordingly, one embodiment of the invention includes a foldable greeting card. The foldable greeting card includes a greeting card body arranged in a single plane, the greeting card body comprising: a first panel; a second panel adjacent the first panel, the second panel comprising a first flap, the first flap comprising a first tab configured to couple to at least a portion of the first panel; a third panel adjacent the second panel; and a fourth panel adjacent the third panel, the fourth panel comprising a second flap, the second flap comprising a second tab configured to couple to at least a portion of the third panel, wherein the fourth panel further comprises a third tab configured to couple to the first panel. The first panel and second panel abut a first fold line, while the second panel and the third panel abut a second fold line, the third panel and the fourth panel abut a third fold line, and the fourth panel and the third tab abut a fourth fold line. In embodiments, the greeting card body is configured to fold between a first configuration and a second configuration, wherein in the first configuration, the greeting card is in a collapsed position, and further wherein in the second configuration, the greeting card is in an expanded position.

In embodiments, the foldable greeting card includes a fourth tab configured to secure a tissue box inside an interior cavity of the greeting card in the expanded position. In further embodiments, at least a portion of the third panel and the fourth panel include a fifth tab configured to secure a tissue box inside an interior cavity of the greeting card in the expanded position. Further, the first flap and second flap are configured to adjoin a top surface of a tissue box, while the first, second, third, and fourth panels are configured to adjoin side surfaces of the tissue box. In embodiments, the first panel includes an inside message for viewing from an inside surface of the greeting card in the collapsed position, with the inside message being viewed from an outside surface of the greeting card in the expanded position. Similarly, in embodiments, the third panel includes an outside message for viewing from an outside surface of the greeting card in the collapsed position, with the outside message being viewed from an outside surface of the greeting card in the expanded position.

A further embodiment of the invention is directed to a foldable greeting card and tissue box cover. The foldable greeting card and tissue box cover includes a greeting card body configured to fold from a collapsed position to an expanded position. In embodiments, the greeting card body includes (1) a first panel; (2) a second panel adjacent the first panel, the second panel comprising a first flap configured to couple to at least a portion of the first panel; (3) a third panel adjacent the second panel; and (4) a fourth panel adjacent the third panel, the fourth panel comprising a second flap configured to couple to at least a portion of the third panel. In embodiments, in the collapsed position, the greeting card body is folded such that the first, second, third, and fourth panels are parallel to a single plane. Further, in the expanded position, the greeting card is folded such that the greeting card body comprises an internal cavity configured to surround at least a portion of a box.

In embodiments, the box enclosed in the cavity of the foldable greeting card and tissue box cover is a tissue box. In further embodiments, the greeting card body includes at least one support tab for securing the box inside the internal cavity. The greeting card may be folded in the collapsed position such that an outside message on the third panel is on an outside surface of the folded greeting card body and an inside message on the first panel is on an inside surface of the folded greeting card body. Further, in some embodiments, an inside message on the first panel and an outside message on the third panel are viewed from an outside surface of the greeting card body in the expanded position. In embodiments, in the expanded position, the first, second, third, and fourth panels are arranged in a vertical direction, and the first flap and second flap are arranged in a horizontal direction. Similarly, in embodiments of the foldable greeting card and tissue box cover in the expanded position, the first, second, third, and fourth panels are arranged in the vertical direction and the first flap and second flap are arranged in the horizontal direction such that the first, second, third, and fourth panels are adjacent vertical surfaces of the box, and the first and second flaps are adjacent a horizontal surface of the box.

In another embodiment of the invention, a foldable tissue box greeting card includes a greeting card body comprising a plurality of panels configured to fold into a plurality of positions, wherein the plurality of positions comprises: a collapsed position, wherein the greeting card body is configured to fit inside a planar envelope; and an expanded position, wherein the greeting card body is configured to surround at least a portion of an exterior of a tissue box.

In embodiments, the foldable tissue box greeting card includes 1) a first panel; 2) a second panel comprising a first flap; 3) a third panel; and 4) a fourth panel comprising a second flap. In embodiments, the expanded position includes an opening that provides access to the surrounded tissue box from a top surface of the greeting card body, wherein the top surface comprises the first flap and the second flap. As such, surrounding at least a portion of an exterior of a tissue box includes adjoining at least one vertical surface of the tissue box and adjoining at least one horizontal surface of the tissue box.

With reference now to the figures, a foldable greeting card and tissue box cover is described in accordance with embodiments of the invention. Various embodiments are described with respect to the figures in which like elements are depicted with like reference numerals.

With reference initially to FIG. 1, in one embodiment of the invention, an exemplary greeting card 10 includes a greeting card body 12 having a first panel 14, a second panel 16, a third panel 18, and a fourth panel 20, arranged in a single plane when in an unfolded position. In embodiments, the card body 12 may be folded into one of multiple positions based on folding along one or more of the exemplary folds depicted in FIG. 1. For example, the card body 12 may be folded along first fold 22, second fold 24, and third fold 26 when arranging the card body 12 in either a collapsed or expanded position. The exemplary greeting card 10 further includes a first flap 28 coupled to the second panel 16, and foldable along a fourth fold 30 between the adjoining second panel 16. The first flap 28 includes a first portion 32 and a second portion 34 that are movable between the expanded and collapsed positions. For example, the first flap 28 remains at least partially concealed inside the collapsed greeting card body 12 of FIG. 2 based on folding of the first portion 32 toward the second portion 34. In embodiments, the first flap 28 includes a first tab 36 configured to couple directly to the first panel 14, thereby positioning the first flap 28 for movement between the collapsed and expanded positions of the greeting card body 12. In further embodiments, the exemplary greeting card 10 includes a second flap 38 coupled to the fourth panel 20, which is foldable along a fifth fold 40 between the adjoining fourth panel 20. The second flap 38 includes a first portion 42 and a second portion 44 that are moveable between the expanded and collapsed positions. For example, the second flap 38 remains at least partially concealed inside the collapsed greeting card body 12 of FIG. 2, based on folding of the first portion 42 toward the second portion 44. In embodiments, the second flap 38 includes a second tab 46 configured to couple directly to the third panel 18, thereby positioning the second flap 38 for movement between the collapsed and expanded positions of the greeting card body 12.

Figure 4:
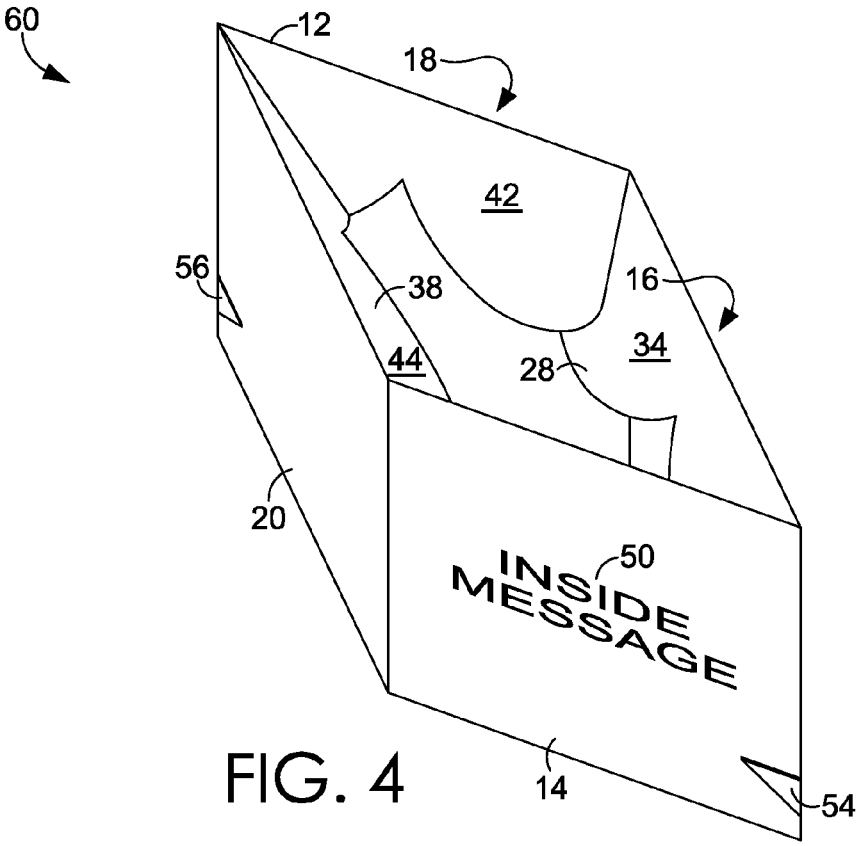
FIG. 4 is a top, perspective view of a partially expanded greeting card, in accordance with an embodiment of the invention.
Figure 5:
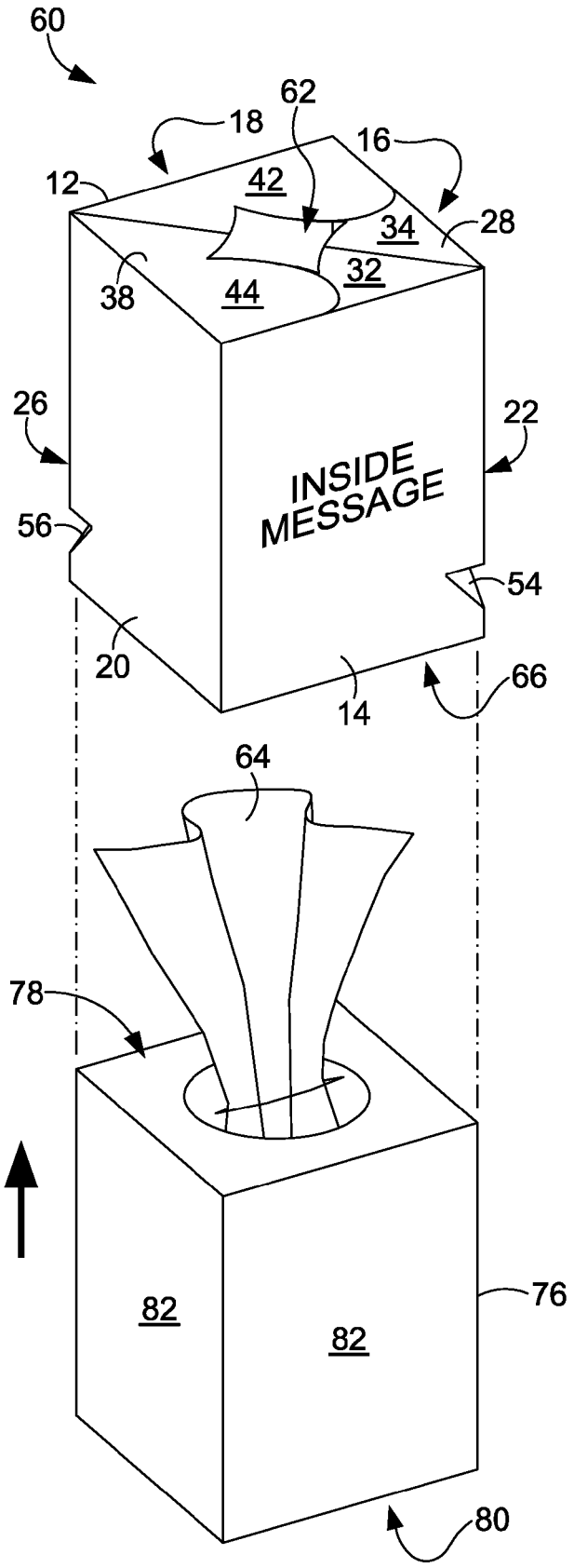
FIG. 5 is a perspective view of an expanded greeting card body for associating with a tissue box, in accordance with an embodiment of the invention.

In embodiments, the exemplary greeting card body 12 further includes a third tab 48 coupled to the fourth panel 20, and configured to fold along a sixth fold 58. The third tab 48 is configured to couple the fourth panel 20 to the first panel 14 during folding of the greeting card body 12. For example, in the collapsed position, an interior, folded-card seam is formed between the edge of fourth panel 20 mated against the edge of the first panel 14, based at least in part on the third tab 48 coupling to at least a portion of the first panel 14. In the expanded position, the greeting card body 12 maintains a central cavity surrounded by the first, second, third, and fourth panels 14, 16, 18, and 20 based on coupling the third tab 48 to the first panel 14, as shown in the example of FIGS. 4-5.

Figure 6:
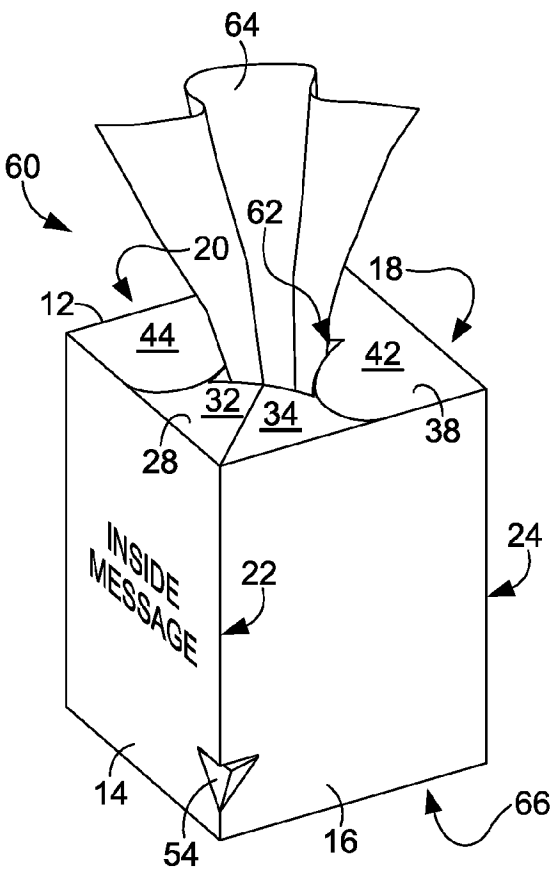
FIG. 6 is a perspective view of an expanded greeting card body coupled to a tissue box, in accordance with an embodiment of the invention.

With continued reference to FIG. 1, embodiments of the greeting card body 12 further include an inside message 50 printed on the first panel 14, and an outside message 52 printed on the third panel 18. As will be understood, the inside message 50 and the outside message 52 may include words, symbols, images, drawings, printed content, etc., and need not include any particular wording or orientation of wording. For example, the inside message 50 may be referred to generally as any content on the surface of the first panel 14 that is viewed from the inside of the folded greeting card in the collapsed position (e.g., FIG. 3). Further, the inside message 50 may also be referred to generally as any content on the surface of the first panel 14 that may be viewed from the outside of the folded greeting card in the expanded position (e.g., FIGS. 5-6). In additional embodiments, outside message 52 may be referred to generally as any content on the surface of the third panel 18 that is viewed from the outside of the folded greeting card in the collapsed position (e.g., FIG. 2), while outside message 52 may be referred to generally as any content on the surface of the third panel 18 that may be viewed from the outside of the folded greeting card in the expanded position (e.g., FIG. 7).

Figure 7:
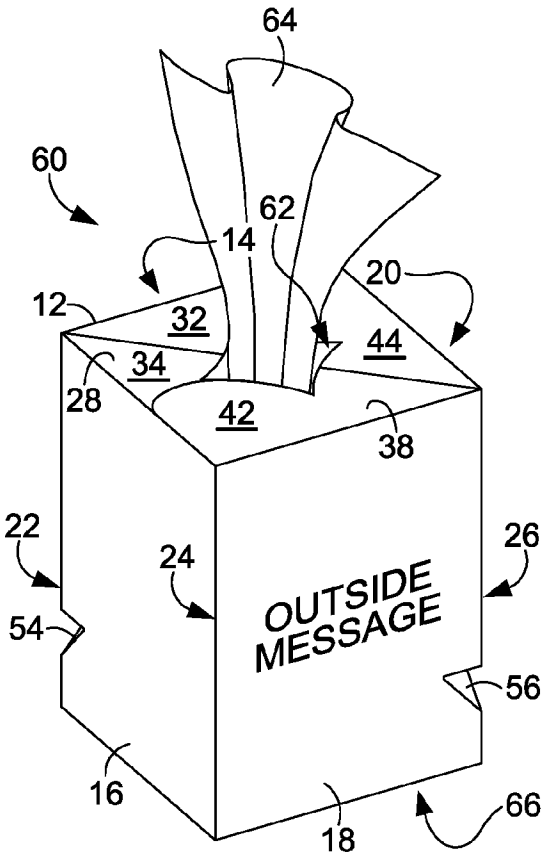
FIG. 7 is a perspective view of an expanded greeting card body coupled to a tissue box, in accordance with an embodiment of the invention.

In the embodiment of FIG. 1, greeting card body 12 further includes a fourth tab 54 coupled to one or more of the first panel 14 and the second panel 16, as well as a fifth tab 56 coupled to one or more of the third panel 18 and the fourth panel 20. In embodiments, fourth tab 54 and/or fifth tab 56 secure the expanded, folded greeting card body 12 coupled to a tissue box, as shown in FIG. 7.

Figure 2:
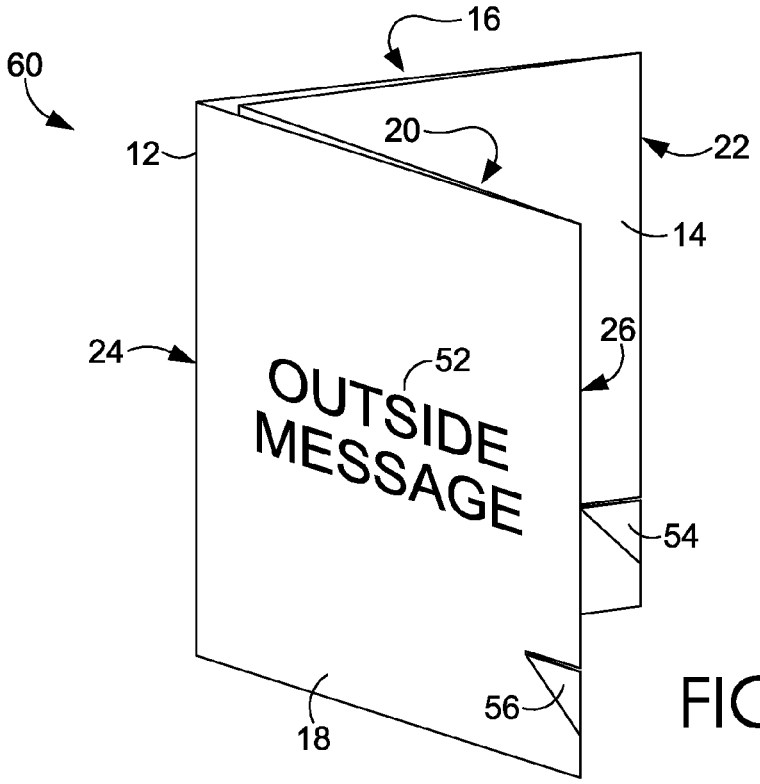
FIG. 2 is a perspective, exterior view of the greeting card body of FIG. 1 in a partially collapsed configuration, in accordance with an embodiment of the invention.
Figure 3:
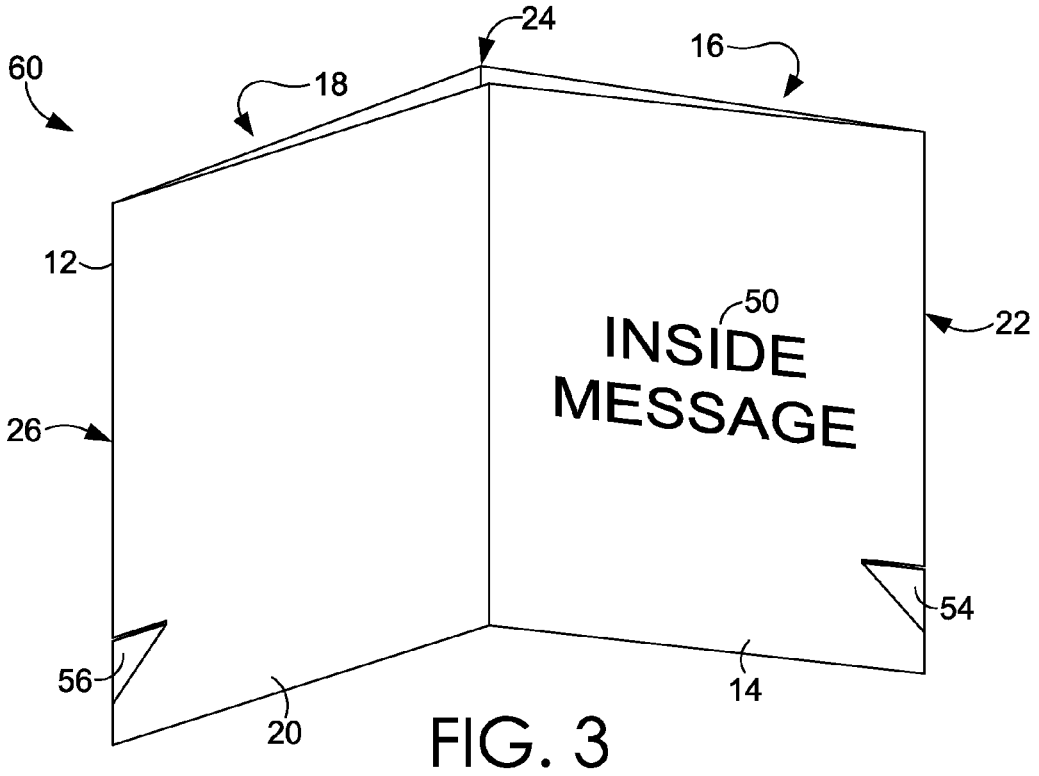
FIG. 3 is a perspective, interior view of the greeting card body of FIG. 1 in a partially collapsed configuration, in accordance with an embodiment of the invention.

Turning now to FIG. 2, the folded greeting card 60 depicts the greeting card body 12 in a partially collapsed configuration. In embodiments, when fully collapsed, the greeting card body 12 may be inserted into a planar envelope for mailing. Based on folding of the greeting card body 12 along the appropriate fold lines, the folded card 60 is configured to position the outside message 52 on an outside surface of the collapsed greeting card body 12, while the inside message 50 remains inside the greeting card, as shown in FIG. 3.

As shown in the embodiment of FIG. 4, a partially expanded greeting card 60 depicts the adjoining first, second, third, and fourth panels 14, 16, 18, and 20 expanding away from contacting the surfaces of each panel, with first flap 28 and second flap 38 lifting into a horizontal position relative to the panels. In one embodiment, based on coupling of the first tab 36 to the first panel 14, first flap 28 raises from being collapsed between first panel 14 and second panel 16 to being perpendicular to the corresponding panels (i.e., first portion 32 adjacent/perpendicular to first panel 14, and second portion 34 adjacent/perpendicular to second panel 16). Similarly, based on coupling of the second tab 46 to the third panel 18, second flap 38 raises from being collapsed between third panel 18 and fourth panel 20 to being perpendicular to the corresponding panels (i.e., first portion 42 is adjacent/perpendicular to third panel 18, and second portion 44 is adjacent/perpendicular to the fourth panel 20).

With reference to the exemplary embodiment of FIG. 5, the expanded greeting card 60 includes an interior cavity 66 for coupling to a top surface 78 of a tissue box 76 having multiple sides 82 that correspond to the multiple panels of the greeting card body 12. In embodiments, the greeting card body 12 may be positioned in an expanded configuration to enclose at least a portion of a tissue box 76 inside the interior cavity 66 while permitting access to the contents of the interior cavity via the opening 62. Accordingly, contents of the tissue box 76, such as tissues 64, may be accessed by a user via the opening 62 of the expanded greeting card 60. In some aspects, a portion of a bottom surface 80 of the tissue box 76 may remain uncovered by the expanded greeting card 60, while in other embodiments, the interior cavity 66 of the expanded greeting card 60 may have a depth configured to enclose the multiple sides 82 from the top surface 78 to the bottom surface 80. In another aspect, based on an opening of the expanded greeting card 60 (i.e., an opening providing access to interior cavity 66), the bottom surface 80 of the tissue box 76 may remain accessible to a user while the expanded greeting card 60 covers one or more portions of the multiple sides 82.

Also shown in FIG. 5, the fourth tab 54 and fifth tab 56 are depicted as being partially depressed towards and/or into the interior cavity 66 of the greeting card body 12 in the expanded position. As such, in FIGS. 6-7, fourth tab 54 and fifth tab 56 secure a tissue box 76 inside of the expanded greeting card body 12. In embodiments, based on expanding of the greeting card body 12, the first flap 28 and the second flap 38 create an opening on a top surface of the expanded greeting card body 12, for access to tissues 64 inside an interior cavity created by the folded greeting card body 12.

Figure 8:
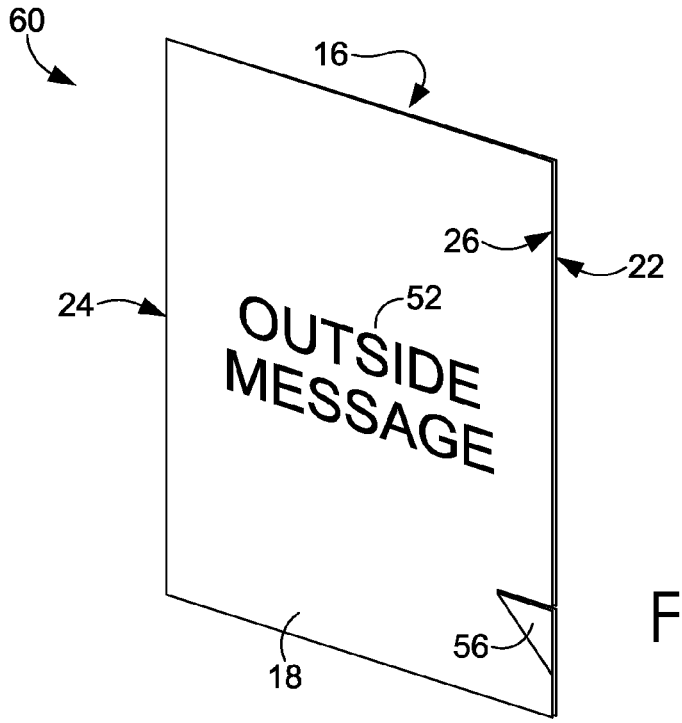
FIG. 8 is a perspective view of a collapsed greeting card body, in accordance with an embodiment of the invention.
Figure 9:
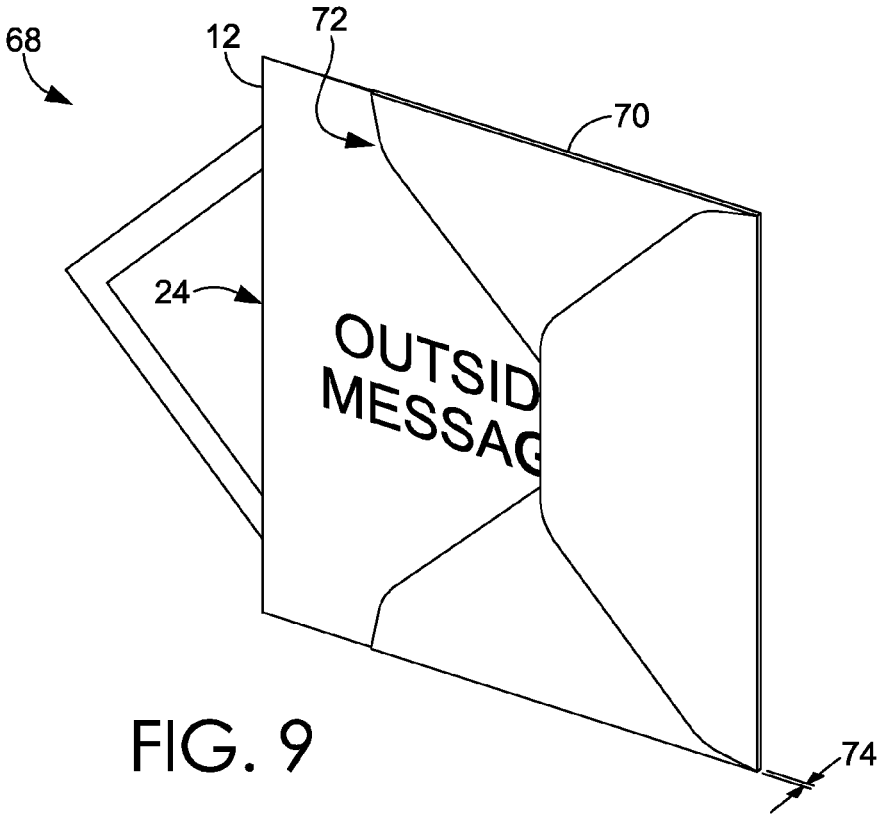
FIG. 9 is a perspective view of the collapsed greeting card body of FIG. 8 being inserted into an interior cavity of an envelope, in accordance with an embodiment of the invention.

In one exemplary embodiment, a greeting card 10 may be mailed in a folded configuration, such as the configuration of FIGS. 8-9, for securing inside a planar envelope 70 having an interior cavity 72. In one embodiment, as shown in FIG. 8, the greeting card 60 may be folded into a collapsed position with first fold 22 adjacent third fold 26. The greeting card 60 may be folded into a collapsed position corresponding to a thickness 74 of an enclosure and/or cavity, such as the envelope 70 having an interior cavity 72 for holding the greeting card body 12. In one aspect, based on folding the greeting card 60 into a collapsed position, it may be stored and/or secured within a compartment (e.g., an envelope 70) for sending to a recipient, as in FIG. 9.

With the greeting card folded into a "collapsed" position (i.e., a traditional, bi-fold greeting card formation for opening by a user), the greeting card may include content on the inside and outside of the folded greeting card body that is viewed accordingly, as in FIGS. 2-3. Once mailed to a recipient, the collapsed greeting card (having both an inside and an outside message in the "collapsed" position) may be maneuvered into the expanded position depicted in FIGS. 5-7, thereby creating a tissue box cover from the once-collapsed greeting card. As such, a flattened and/or collapsed greeting card, formed from a single greeting card body, may be folded between multiple positions to serve as both a traditional greeting card and a tissue box cover. In embodiments, the expanded tissue box cover displays both the internal and external messages of the greeting card to the recipient.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A foldable greeting card comprising:

a greeting card body arranged in a single plane, the greeting card body comprising:

(1) a first panel;

(2) a second panel adjacent the first panel, the second panel comprising a first flap, the first flap comprising a first tab configured to couple to at least a portion of the first panel;

(3) a third panel adjacent the second panel; and (4) a fourth panel adjacent the third panel, the fourth panel comprising a second flap, the second flap comprising a second tab configured to couple to at least a portion of the third panel, wherein the fourth panel further comprises a third tab configured to couple to the first panel, wherein the first panel and second panel abut a first fold line, wherein the second panel and the third panel abut a second fold line, wherein the third panel and the fourth panel abut a third fold line, wherein the fourth panel and the third tab abut a fourth fold line, and wherein the greeting card body is configured to fold between a first configuration and a second configuration, wherein in the first configuration, the greeting card is in a collapsed position having a rectangular shape based on the third panel forming a folded greeting card front side and the second panel forming a folded greeting card back side opposite the front side, and further wherein in the second configuration, the greeting card is in an expanded position having an interior cavity configured to surround an existing tissue box, wherein the interior cavity comprises:

(1) an open bottom configured to slide over the existing tissue box;

(2) an upper surface formed from at least the first and second flaps, said upper surface configured to abut a top surface of the existing tissue box; and (3) an opening in the upper surface providing access to retrieve tissues from the existing tissue box, said opening formed between at least a portion of the first flap and at least a portion of the second flap.

2. The foldable greeting card of claim 1, wherein when the first flap and second flap adjoin the top surface of the existing tissue box, the first, second, third, and fourth panels are configured to adjoin side surfaces of the tissue box.

3. The foldable greeting card of claim 1, wherein the first panel comprises an inside message for viewing from an inside surface between the front side and the back side of the greeting card in the collapsed position.

4. The foldable greeting card of claim 3, wherein the inside message is viewed from an outside surface of the greeting card in the expanded position.

5. The foldable greeting card of claim 1, wherein the third panel comprises an outside message for viewing from an outside surface of the greeting card in the collapsed position.

6. The foldable greeting card of claim 5, wherein the outside message is viewed from an outside surface of the greeting card in the expanded position.

7. The foldable greeting card of claim 1, wherein at least a portion of the first panel and the second panel comprise a fourth tab configured to secure a tissue box inside the interior cavity of the greeting card in the expanded position.

8. The foldable greeting card of claim 1, wherein at least a portion of the third panel and the fourth panel comprise a fifth tab configured to secure a tissue box inside the interior cavity of the greeting card in the expanded position.

9. A foldable greeting card comprising:

a greeting card body configured to fold from a collapsed position having a rectangular greeting card orientation to an expanded position having an interior tissue box cavity, the greeting card body comprising:

(1) a first panel;

(2) a second panel adjacent the first panel, the second panel comprising a first flap configured to couple to at least a portion of the first panel;

(3) a third panel adjacent the second panel; and (4) a fourth panel adjacent the third panel, the fourth panel comprising a second flap configured to couple to at least a portion of the third panel, wherein in the collapsed position, the greeting card body is folded such that the first, second, third, and fourth panels are parallel to a single plane of a folded greeting card body, the second and third panels are positioned on exterior surfaces of the rectangular greeting card orientation, and the first and fourth panels are positioned on inside surfaces of the rectangular greeting card orientation, and further wherein in the expanded position, the interior tissue box cavity is configured to surround at least a portion of an existing tissue box inside the interior cavity, said interior cavity comprising an open bottom to slide over the existing tissue box, an upper surface comprising the first and second flaps, and an opening providing access via the upper surface to retrieve tissues from the tissue box, wherein the first flap and the second flap cooperate to form the upper surface and the opening.

10. The foldable greeting card of claim 9, wherein at least two panels of the greeting card body comprise at least one support tab for securing the at least a portion of a tissue box inside the interior cavity.

11. The foldable greeting card of claim 9, wherein the greeting card is folded in the collapsed position such that an outside message on the third panel is on an outside surface of the folded greeting card body and an inside message on the first panel is on an inside surface of the folded greeting card body.

12. The foldable greeting card of claim 9, wherein an inside message on the first panel and an outside message on the third panel are viewed from an outside surface of the greeting card body in the expanded position.

13. The foldable greeting card of claim 9, wherein in the expanded position, the first, second, third, and fourth panels are arranged in a vertical orientation and the first flap and the second flap are arranged in a horizontal orientation.

14. The foldable greeting card of claim 13, wherein the first, second, third, and fourth panels are arranged in the vertical orientation and the first flap and second flap are arranged in the horizontal orientation such that the first, second, third and fourth panels are configured to be positioned adjacent vertical surfaces of the existing tissue box inside the tissue box cavity, and the first and second flaps are adjacent a horizontal, top surface of the existing tissue box inside the tissue box cavity.

15. A foldable tissue box greeting card, the greeting card comprising:

a greeting card body comprising a plurality of panels and a plurality of flaps, the greeting card body configured to fold into a plurality of positions, wherein the plurality of positions comprises:

(1) a collapsed position having a greeting card front side, a greeting card back side, and a greeting card interior positioned between the front side and the back side, wherein the greeting card body is configured to fit inside a planar envelope in the collapsed position; and (2) an expanded position comprising an interior cavity, wherein the greeting card body is configured to surround at least a portion of an exterior of a tissue box in the internal cavity, wherein the internal cavity comprises an open bottom to slide over the tissue box, an upper surface formed from the plurality of flaps, and an access opening in the upper surface for retrieving tissues from inside the internal cavity, said access opening formed between at least two of the plurality of flaps.

16. The foldable tissue box greeting card of claim 15, wherein surrounding at least a portion of an exterior of a tissue box comprises adjoining at least one vertical surface of the greeting card body and adjoining at least one horizontal surface of the greeting card body to provide at least a portion of the internal cavity.

17. The foldable tissue box greeting card of claim 15, wherein at least one tab on the greeting card body is configured to couple to at least one of the plurality of panels to provide the internal cavity in the expanded position.

18. The foldable tissue box greeting card of claim 15, wherein the plurality of panels and plurality of flaps comprises:

(1) a first panel;

(2) a second panel comprising a first flap;

(3) a third panel; and (4) a fourth panel comprising a second flap, wherein in the collapsed position, the first flap is positioned between the second panel and the first panel, and the second flap is positioned between the third panel and the fourth panel.

19. The foldable tissue box greeting card of claim 18, wherein the expanded position comprises an opening that provides access to the surrounded tissue box from a top surface of the greeting card body, wherein the top surface comprises the first flap and the second flap.

* * * * *